US007584849B2

(12) United States Patent
Mauk

(10) Patent No.: US 7,584,849 B2
(45) Date of Patent: Sep. 8, 2009

(54) HOME MEDICINE STATION

(76) Inventor: Milford Vincent Mauk, 12145 Prairie Hill Rd., Hearne, TX (US) 77859

( * ) Notice: Subject to any disclaimer, the term of this patent is extended or adjusted under 35 U.S.C. 154(b) by 380 days.

(21) Appl. No.: 11/492,406

(22) Filed: Jul. 25, 2006

(65) Prior Publication Data

US 2007/0023318 A1 Feb. 1, 2007

Related U.S. Application Data

(60) Provisional application No. 60/704,246, filed on Jul. 26, 2005.

(51) Int. Cl.
*B65D 69/00* (2006.01)
*B65D 1/34* (2006.01)
*B65D 83/04* (2006.01)
*B65D 85/00* (2006.01)

(52) U.S. Cl. ..... 206/570; 206/459.1; 206/534; 206/564

(58) Field of Classification Search ..... 206/538, 206/570, 571, 528, 803, 828, 534, 232
See application file for complete search history.

(56) References Cited

U.S. PATENT DOCUMENTS 2,790,547 A * 4/1957 Sutton ..... 206/571
4,308,937 A 8/1977 Kell
4,303,158 A * 12/1981 Perkins ..... 206/373
4,522,302 A * 6/1985 Paikoff ..... 206/570
D283,249 S 4/1986 Clark
4,717,042 A 1/1988 McLaughlin
4,863,451 A * 9/1989 Marder ..... 604/403
4,898,195 A * 2/1990 Sussman ..... 132/317
5,062,531 A 11/1991 Coy
5,159,581 A * 10/1992 Agans ..... 368/10
5,174,451 A * 12/1992 Niven ..... 206/534
5,289,919 A * 3/1994 Fischer ..... 206/571
5,397,875 A * 3/1995 Bechtold, Jr. ..... 219/521
5,727,701 A * 3/1998 Rhoades ..... 211/70.6
5,774,865 A 6/1998 Glynn
5,850,917 A * 12/1998 Denton et al. ..... 206/366
6,011,999 A * 1/2000 Holmes ..... 700/231
6,167,680 B1 * 1/2001 Horn ..... 53/473
6,169,707 B1 * 1/2001 Newland ..... 368/10
6,464,506 B1 * 10/2002 Welles ..... 434/238
6,540,082 B2 4/2003 Peterson
6,543,616 B1 4/2003 Peterson
6,550,618 B2 4/2003 Peterson
6,766,920 B2 7/2004 Yuyama et al.
6,860,390 B2 * 3/2005 Bowman ..... 206/534
6,971,522 B2 * 12/2005 Yuyama et al. ..... 206/538
7,004,324 B1 * 2/2006 Delorio ..... 206/570

(Continued)

*Primary Examiner*—Mickey Yu
*Assistant Examiner*—Melissa L Lalli
(74) *Attorney, Agent, or Firm*—Buskop Law Group, PC; Wendy Buskop

(57) ABSTRACT

A medicine apparatus for storing medicine pill vials; indicator for indicating day, segment of day and time; seven days with four segments per day medicine dispensers; area for sorting medicines; and weekly communications sheets which will be stored as medical records. All the above mentioned elements are embodied within one housing so as to be available in one convenient location. The apparatus has been designated for medical patients who may be experiencing dementia as well as patients who may be losing dexterity in their hands. The apparatus is molded from inert materials such as plastics thus allowing for the said apparatus to be lightweight yet durable and inexpensive.

12 Claims, 9 Drawing Sheets

U.S. PATENT DOCUMENTS 7,017,513 B2 3/2006 Giewercer
2004/0168954 A1* 9/2004 Hannan et al. ..... 206/594
2006/0169621 A1* 8/2006 Rulifson ..... 206/534

* cited by examiner

HOME MEDICINE STATION

CROSS-REFERENCE TO RELATED APPLICATIONS

This application claims the benefit of U.S. provisional patent application Ser. No. 60/704,246 filed on Jul. 26, 2005 by the present inventor.

FEDERALLY SPONSORED RESEARCH

Not Applicable

SEQUENCE LISTING OR PROGRAM

Not Applicable

FIELD OF INVENTION

This invention relates generally to medicine dispensing for individual timed doses of medicine on a daily basis over a prescribed period of time, such as a week, for compliance with a dosage regiment. More particularly this invention will store medicine pill vials, constantly indicate times for correct medicines, securely hold daily medicine dispensers, allow for medical communications and storage of said communication sheets as records, all said elements embodied within one medicine apparatus.

BACKGROUND OF THE INVENTION

This invention relates generally to medical devices and more specifically to dispensing of medications for home or institution care where the patient must take multiple medicines at predetermined intervals. Some type of medical therapy requires patients to take many different types of medications, often in the form of pills or capsules at regular intervals. Failure to take a medication when prescribed or double dosing because a patient has forgotten that they have already taken their medication is a common problem. The problem is compounded when multiple medications with different prescribed dose frequencies are being used at one time.

Research into the issues of prescription medication non-compliance indicated the significant consequences that result. The National Pharmaceutical Council estimates that non-compliance costs more than 100 billion dollars a year in the USA alone in increased hospital and nursing home admissions, lost productivity and premature deaths. Ninety percent of elderly patients made some medication errors. Older adults average 2.3 serious medication errors per patient per month (Green et al., 1995). Non-compliance is directly responsible for the admission of 380,000 patients to nursing homes each year (23% of all nursing home admissions). In 60% of all nursing home admissions non-compliance is a greater factor than the person's actual medical condition (Col, Fanale & Kronholm, 1990, Merchenbaum & Turk 1997).

The use of medicines and pills has often proven an inconvenience, particularly when a patient is being administered more than one type of pill. Common is the scene of a crowded and overflowing medicine chest where shelf upon shelf is overlaiden with required drugs. Such a sight of disorderliness only increases the anxiety of the patient.

Often times laying the required medications out on a table or countertop does little to alleviate the aggravating condition. This situation is particularly distressing for the elderly patient who struggles to maintain their independence and would like to find some way to organize their entourage of pill vials. One way of accomplishing this is to organize his pills in a safe and orderly fashion. Safe so that no needed medication is overlooked. Orderly so that the pills may be organized, but not hidden or misplaced.

Accordingly, there has been a need for a medicine apparatus designed to store, indicate, dispense, and communicate for use in health care industry to assist those required to take medications at regular intervals. Such a medicine apparatus should be of durable construction and easy to assemble and operate. Additionally there exists a need for medicine dispensing which minimizes the change of an accidental overdose or under dose of medications. The invention that I present fulfill these needs and provides other related advantages.

DESCRIPTION OF PRIOR ART

There are some patents that I am aware of that have made attempts at solving the above the above-mentioned situation, these are as follows.

Mr. Kjell was issued U.S. Pat. No. 4,038,937 on Aug. 2, 1977 the entitled Medicine Dispenser and Method. The invention was an improved portable dispenser for medicines and included a disposable tray insert. There are enough separate compartments for four segments per day for a seven-day period. The first improvement my invention provides, is to have the pill vials stored within the housing allowing for one convenient location for the medicines. The second improvement is the ability for the day, segment of the day, and time indicator to be located directly beside the medicine dispensers. A third major improvement is the communication/record drawer allowing for medical communications to be located directly below the indicator and dispensers within the same housing.

Mr. McLaughlin was issued U.S. Pat. No. 4,717,042 on Jan. 5, 1988; the invention is named Medicine Dispenser for Home Health Care. This invention is basically a daily medicine dispenser with a microprocessor to control the opening of the medicine compartments. The said invention has electrically controlled solenoids that release the lid allowing the medicine compartments to open. His invention has audible and visual indicators. The first improvement my invention makes over the above patent is to allow for medicines to be arranged for seven individual days. The second is to store pill vials and label each pill vial individually. A third major improvement is the communication/record drawer allowing for medical communications to be located directly below the indicator and dispensers within the same housing.

Mr. Newland was issued U.S. Pat. No. 6,169,707 on Jan. 2, 2001; the invention is named Medicine storage and Reminder Device. This invention deviates from Mr. John McLaughlin patent by the use of computer inputs and the use of light emitting diodes to indicate which medicines should be taken at prescribed times. The cost of the computer, modems, programs and programmers would be cost inhibiting in most cases. My invention is designed for ease of use by older patents that may not be computer literate. My design being molded from plastic is lightweight, durable, easy to assemble, easy to use and inexpensive.

Mr. Peterson was issued U.S. Pat. No. 6,543,616 B1 on Apr. 8, 2003 the invention is named Medicine Dispensing Tray with Information Cover. This invention has a seven day, four segment pill dispensers and supplies another medicine information label mimicking the label that is installed on the pill vials by a pharmacy. There seems to be two versions of the above patent. The first version has a rigid plastic cover with the information cards firmly attached. The second version has the information sheet attached with a ring to the dispenser. The major theme of his invention is that if a patient drops the dispensing tray they will be able to replace the medicines, with the help of the medicine's picture and the information sheet. The invention that I am proposing has the original pill vials dispensed by a pharmacy. There will not be a need for additional information sheets that could be lost or a typing error having possible grave consequences. Another distinct advantage is the ability of the weekly communication sheet to have a checklist for the daily medicines. Another improvement is the ability to store the weekly communication sheets, which will allow for forming medical records of medical concerns that a patient may have.

SUMMARY

The present invention provides a medicine apparatus that is intended and designed to overcome the limitations of the prior art. The apparatus is intended to be used in instances where a patient has been prescribed multiple different medications, which must be taken on a fixed schedule. The use of medicine has often proved an inconvenience, particularly when a patient is being administered more than one type of medicine. Common is the scene of a crowed and overflowing medicine chest where shelf upon shelf is overlaiden with required drugs. Such a sight of disorder only increases the anxiety of the patient. This invention will contain the necessary elements to help alleviate many of the insecurities a patient may have when taking their prescribed medications.

The invention resides in an improved medicine system; for storing pill vials indicating time to administer, dispensers, recording medical events and storing weekly communication sheets. The said invention will embody necessary elements to assist a patient in following a rigid schedule for taking prescribed medications and communicating any medical concerns.

Having the ability to store weekly communication sheets, the health care provider has accurate information to see a possible dangerous medical trend developing with the patient. Keeping the patient involved it will allow them to feel as if they still have a degree of control in their lives. This will inspire them to even take more interest in their health.

The said invention has been designed for patients who may be experiencing dementia. Another design criteria has been for patient who may have concerns with dexterity in their hands. The said invention has been designed to be very durable in case of accidental physical abuse.

Another design criteria was to develop the said invention using the Julian calendar and a seven-day period to alleviate possible confusion. Extreme effort has gone into insuring that the elements have the ability to be used by the patient where no discontinuities are present that might add any confusion in the administering of medications.

BRIEF DESCRIPTION OF THE DRAWING

The accompanying drawings illustrate the invention.

DETAILED DESCRIPTION OF THE PREFERRED EMBODIMENT OF THE PRESENT INVENTION

Figure 1:
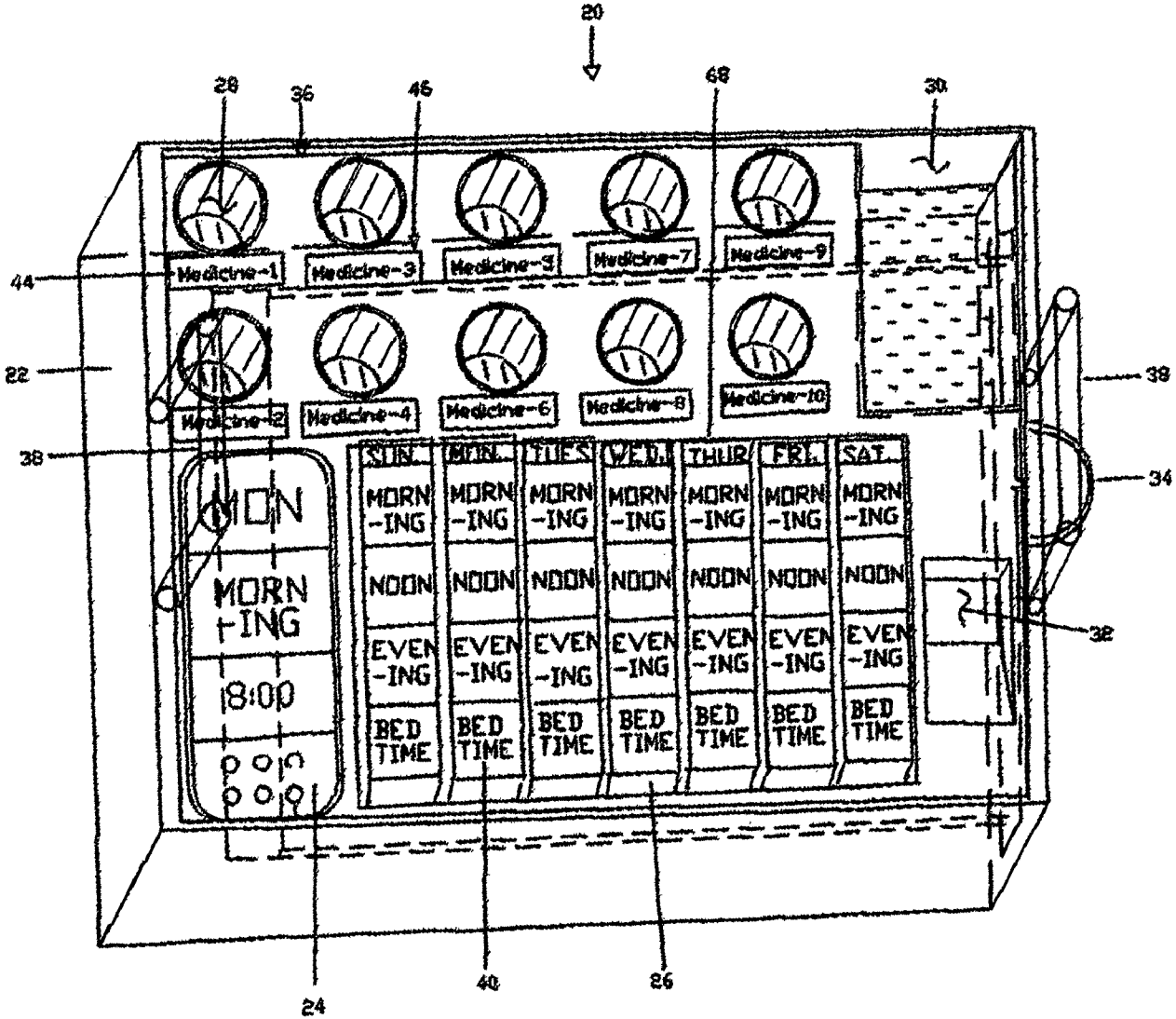
FIG. 1 is a Perspective view of a preferred form of the medicine apparatus. Most hidden lines are removed for clarity of this view.
Figure 2:
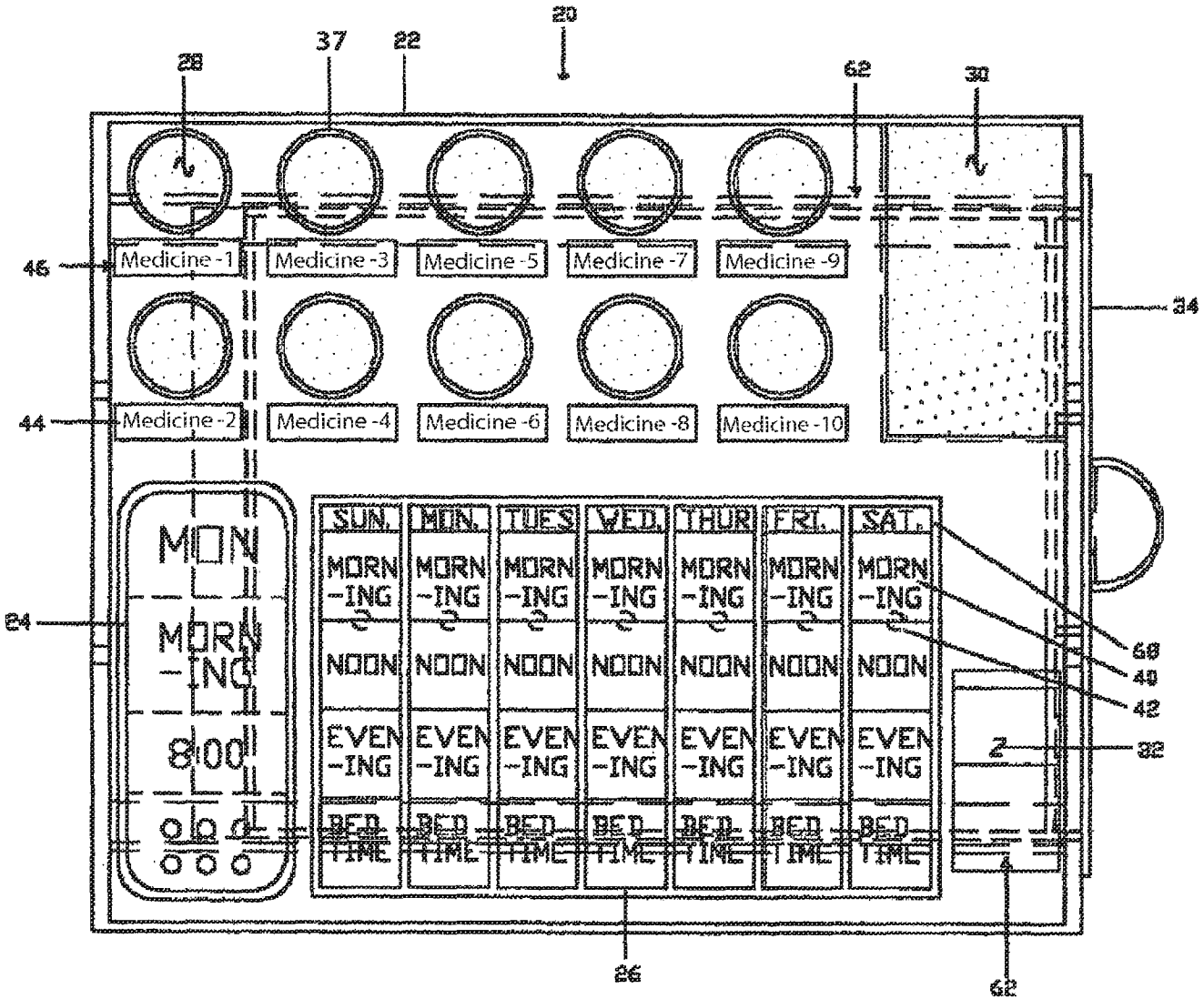
FIG. 2 is the plan view of the preferred embodiment of the invention.
Figure 3:
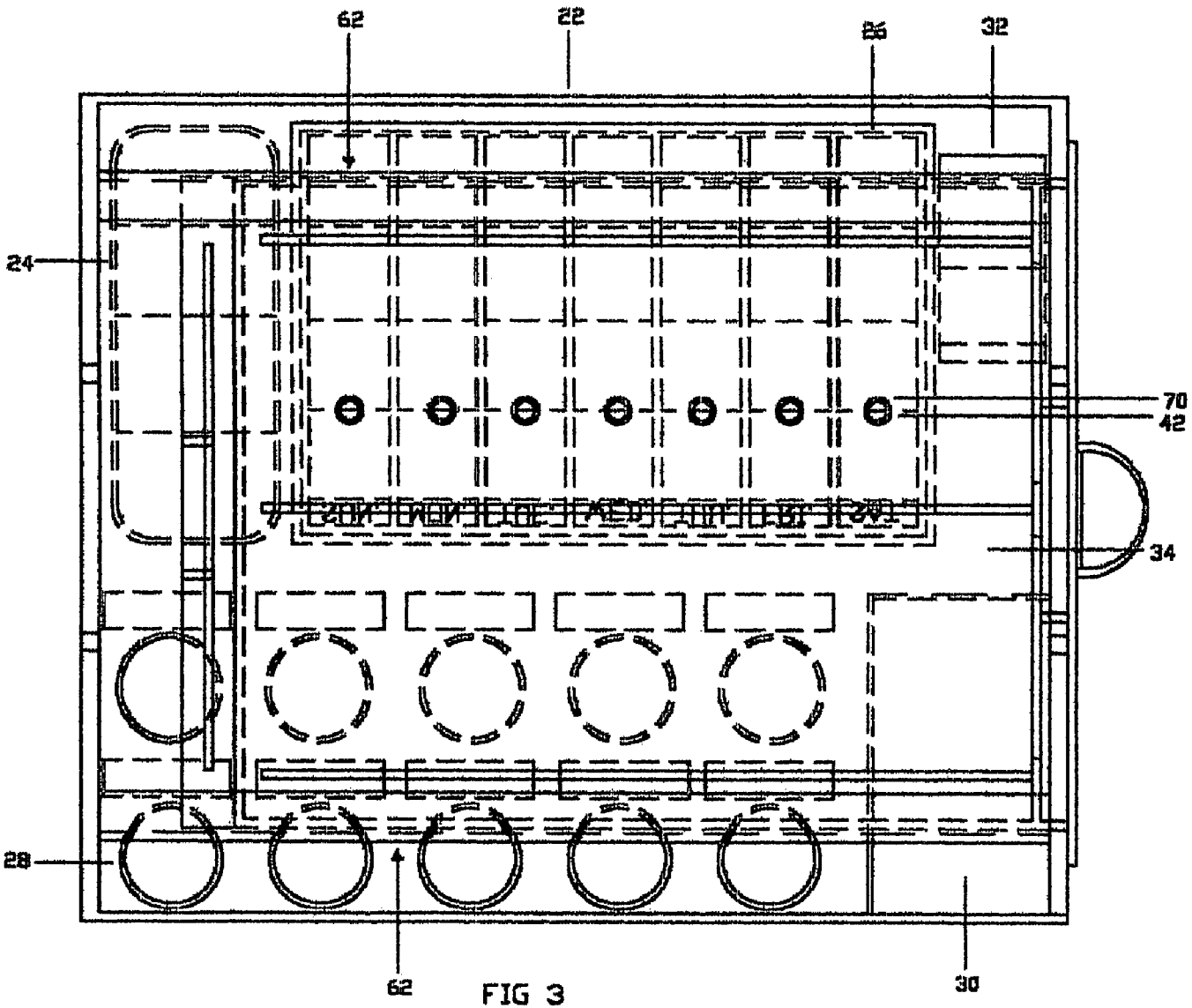
FIG. 3 is the bottom view of the apparatus.
Figure 4:
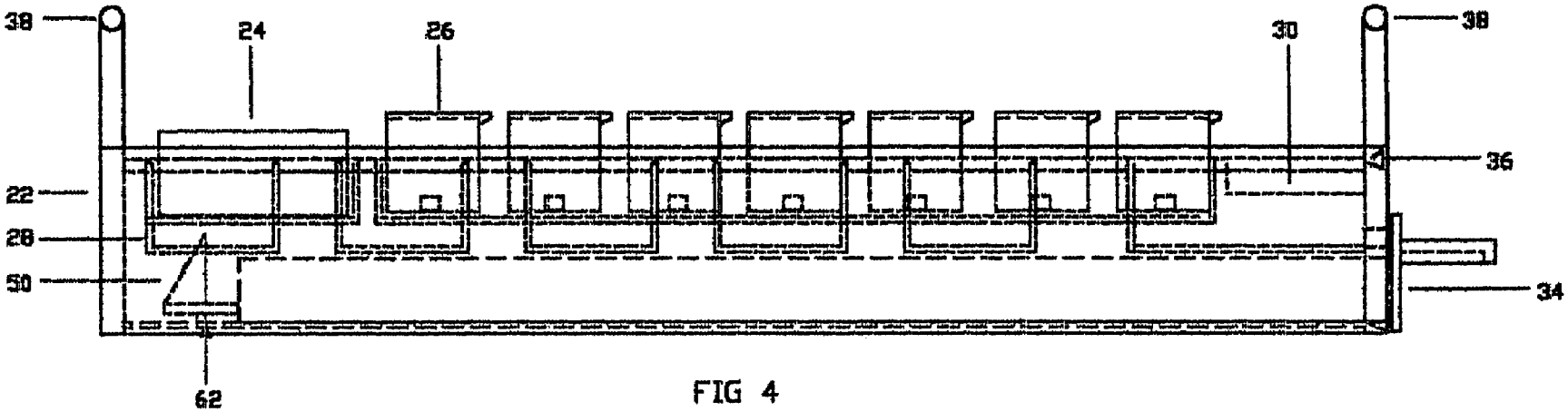
FIG. 4 is the front view of the apparatus.
Figure 5:
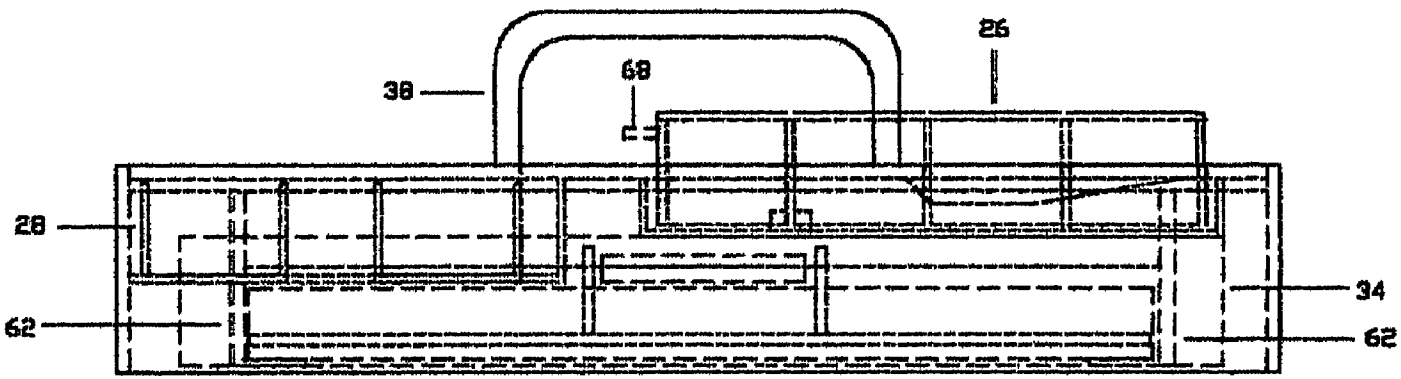
FIG. 5 is the left side view of the apparatus.
Figure 6:
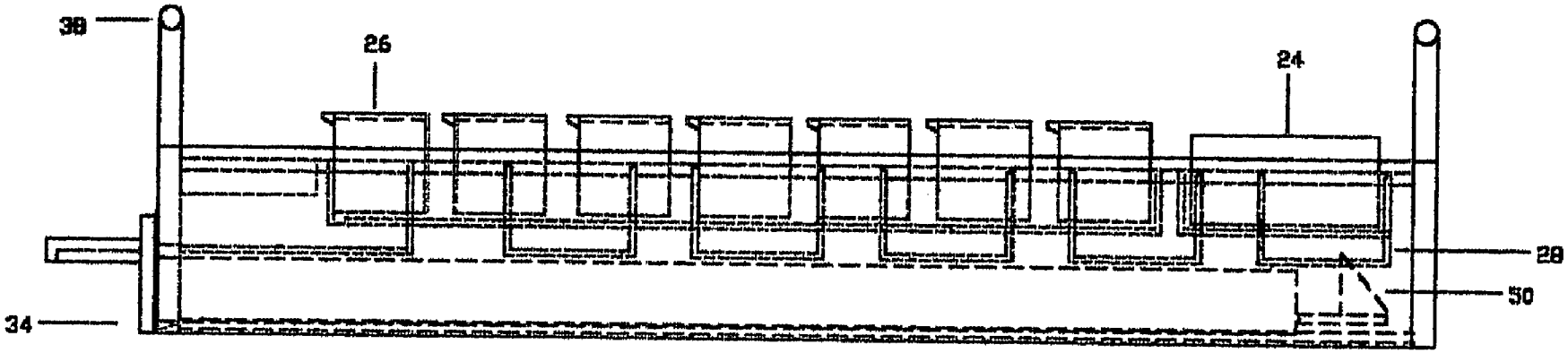
FIG. 6 is the back view of the apparatus.
Figure 7:
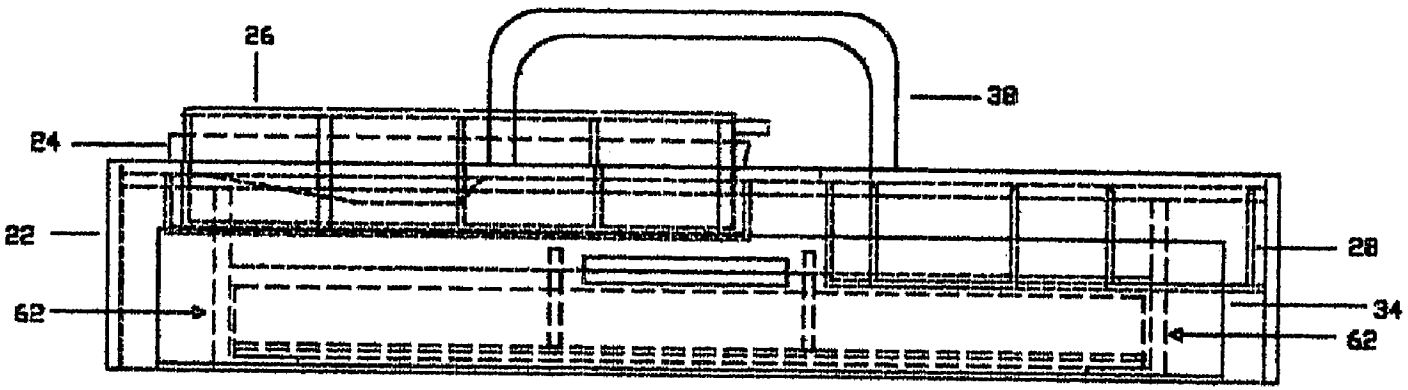
FIG. 7 is the right side view of the apparatus.
Figure 8:
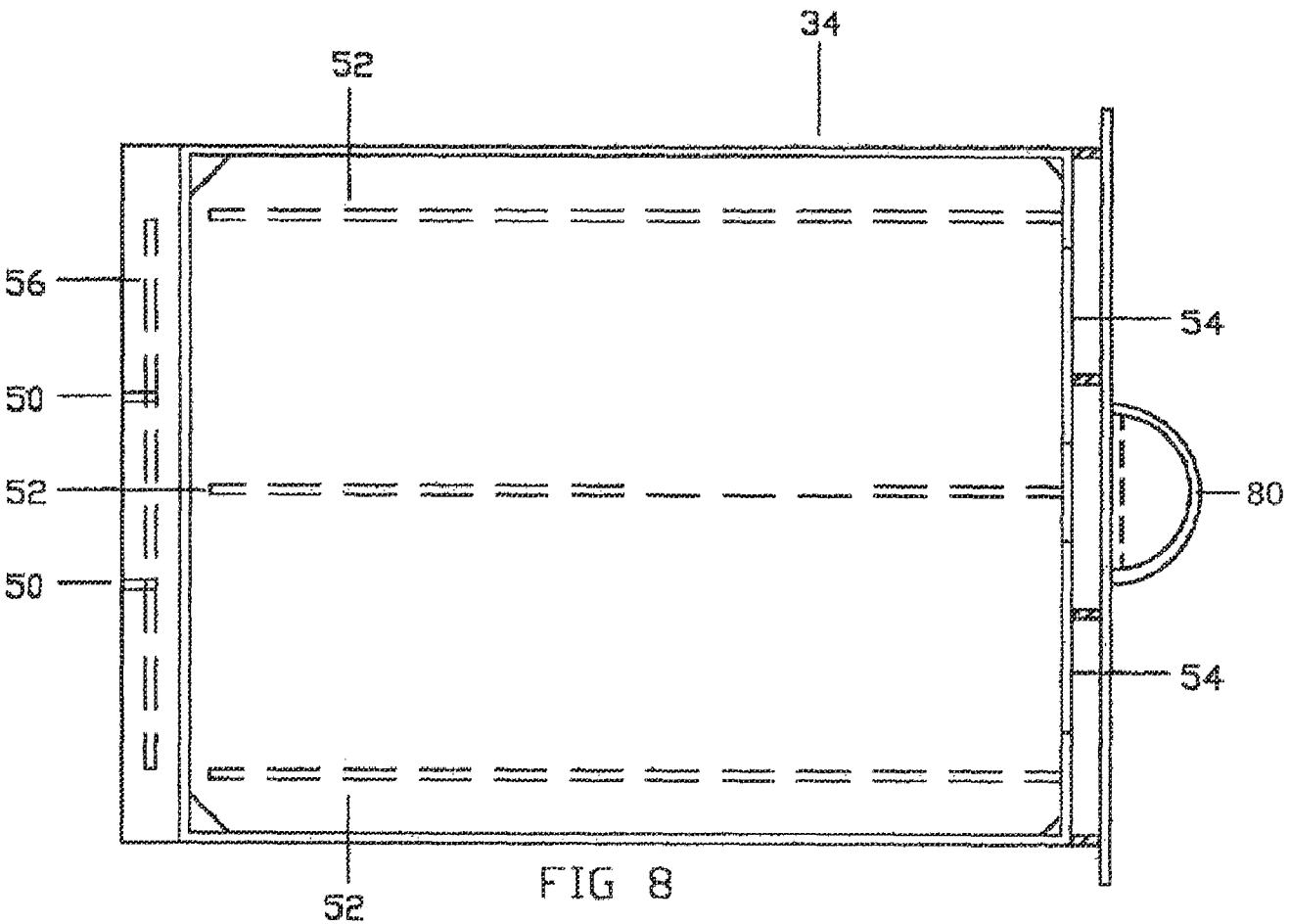
FIG. 8 is the top view of the Communication/Records drawer.
Figure 9:
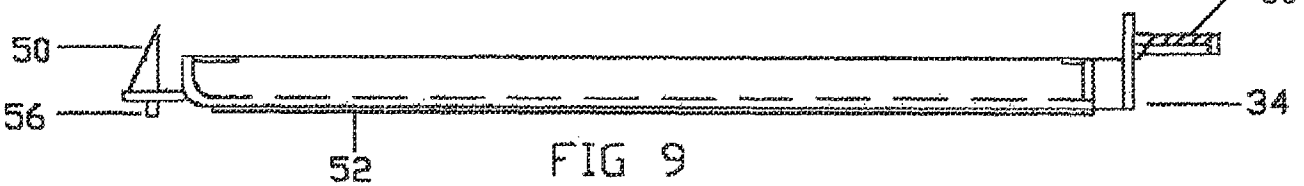
FIG. 9 is the front view of the Communication/Records drawer.
Figure 10:
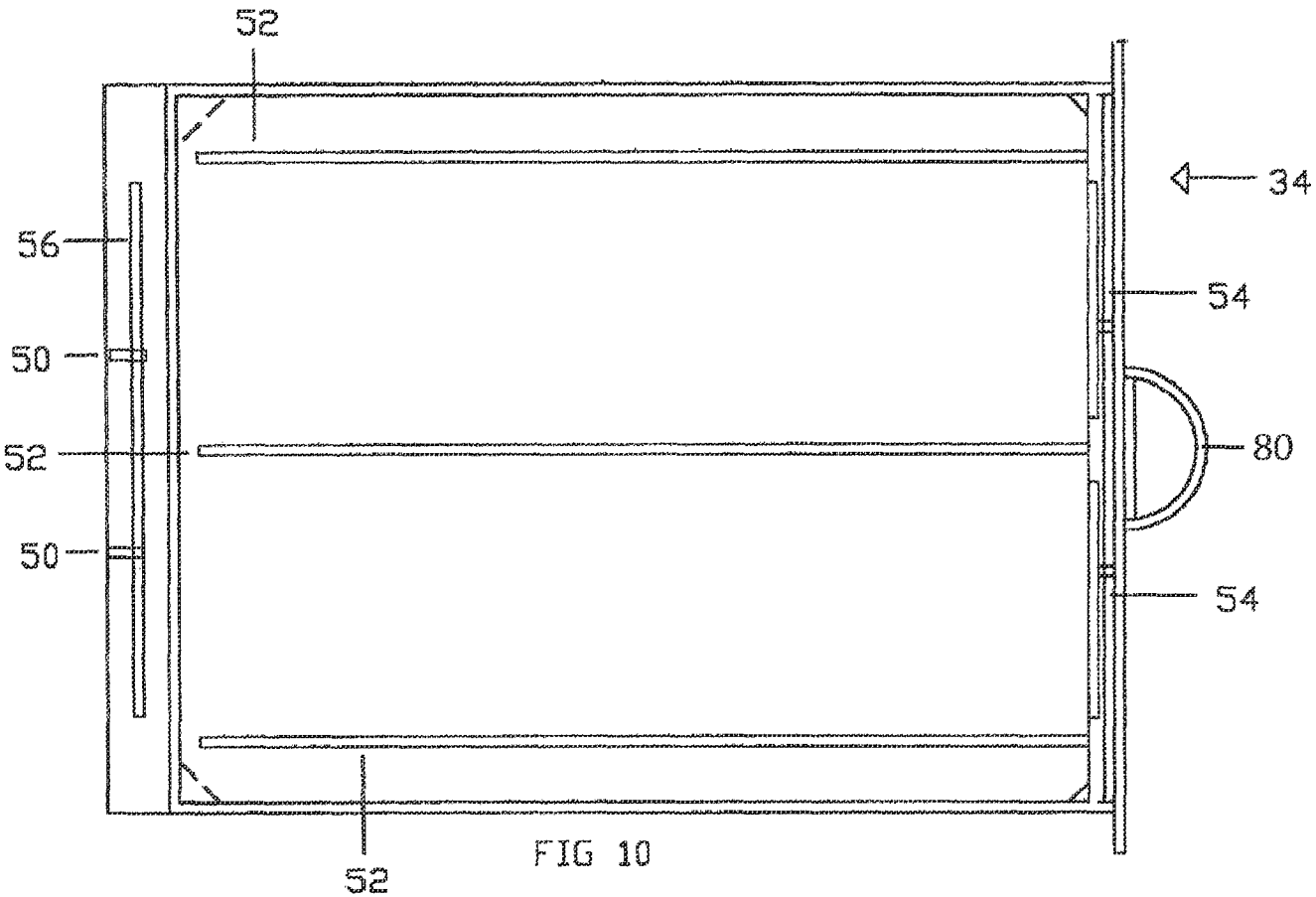
FIG. 10 is the bottom view of the Communication/Records drawer.
Figure 11:
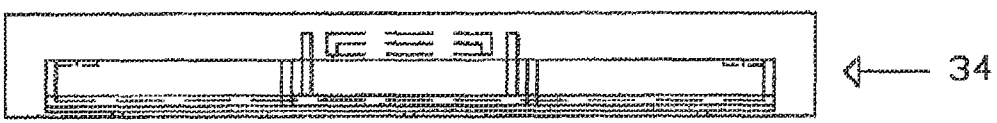
FIG. 11 is the left side view of the Communication/Records drawer.

The invention has been designed using a common medicine-administering scheme used by physicians, nursing homes, home health care services and such. The invention will allow for a single all inclusive location for a medicine dispensing apparatus for administering medications on a daily basis over a period of time, such as a week, with the added ability for medical communication and medical records storage.

The drawing discloses a preferred embodiment of the present invention. While the configuration according to the illustrated embodiment is preferred, it is envisioned that alternate configurations of the present invention may be adopted without deviating from the invention as portrayed. The preferred embodiment is discussed hereafter.

Referring now to the drawings and firstly to FIGS. 1,2,3, 4,5,6,7, the preferred embodiment of the invention is generally shown at numeral 20 and includes a molded plastic housing 22, an indicator 24, and refillable medicine dispensers 26. The housing 22 includes an array of upward facing integrally recessed areas for storage of ten standard medicine pill vials 28 having forty five degree flares 37 (seen in FIG. 2). The housing 22 includes an upward facing integrally recessed area for the storage of larger medicine containers 30. The housing 22 includes an upward facing integrally recessed area to securely hold the indicator 24. The housing includes an upward facing integrally recessed area to hold daily medicine dispensers 26. The housing 22 includes upward facing integrally recessed containment area for sorting medicines 32. The housing 22 includes a side opening and supports for a communications/records drawer 34. The housing 22 will be formed from medically accepted plastics. There is a one-eighth inch upper boundary 36 to keep all medications contained within the housing 22. The housing 22 will include two ergonomically designed handles 38 to allow for easy movement of the medicine apparatus.

This embodiment 20 incorporates a continuously display indicator 24, that advises the patient of the day, segments of the day, and time. The indicator 24 has the ability to be set to customize the time for the segments of the day. When the clock circuit goes to 12:00 p.m. the indicator will display the new day and the preset segment functions for that day will operate as per the settings for that day.

Figure 14:
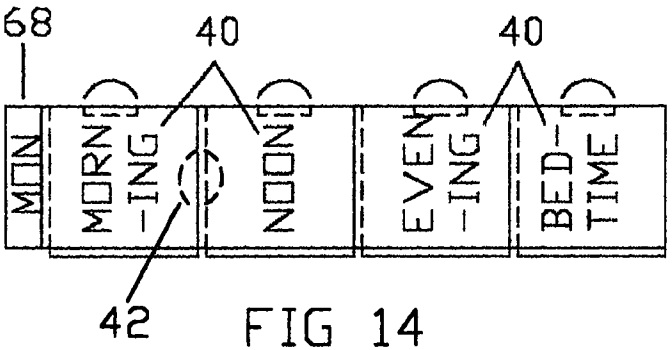
FIG. 14 is the plan view of the Medicine Dispensers; Monday is shown as an example for the seven-day set.
Figure 15:
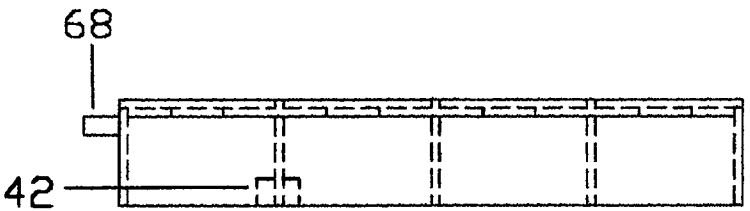
FIG. 15 is the front view of the above mentioned medicine dispensers.

The embodiment 20 incorporates a seven-day set of individual daily dispensers 26 with each dispenser incorporating individual cubicles for four individual segments per day. Referring to FIG. 14 and FIG. 15 the said individual dispensers will incorporate a tab correctly labeled with the abbreviated day for easy of identifying and grasping 68. After removing the correct day and identifying the correct segment of the day, the medicine is placed in the medicine sorting area 32, for ease of handling. The said medical dispensers 26 will hold a seven-day supply of medicines, Sun.-Sat. Each of the four daily segments have a latch able lid that will securely seal the segments until manually opened by the patient. The said cubicles have been sized to hold a multiple of different medications. Each segment will be identified by permanent markings of the said segments by bold ink print 40. The said dispensers will be held in place by an indented contact area on the bottom of the dispenser 42. This indented area will contact a matched area on the housing 70, to secure the dispensers in place until needed.

The embodiment 20 will include a medicine sorting area 32 with a graduated inclined surface. This sorting area is sized to be helpful to individuals who may be experiencing lose of dexterity in their hands. The sorting area 32 can also be used as a convenient location for sorting medication when refilling the seven-day dispensers.

The embodiment 20 will supply a labeling area 44 below each recessed storage area 28 for assigning location for individual medicines. The size for the labeling areas 44 have been designed to accommodate a label that is commonly used for return addresses on postal packages. A raised shoulder completely surrounding said areas 46 will protect the labels. Printing of the said labels can be computer generated or hand written.

Figure 12:
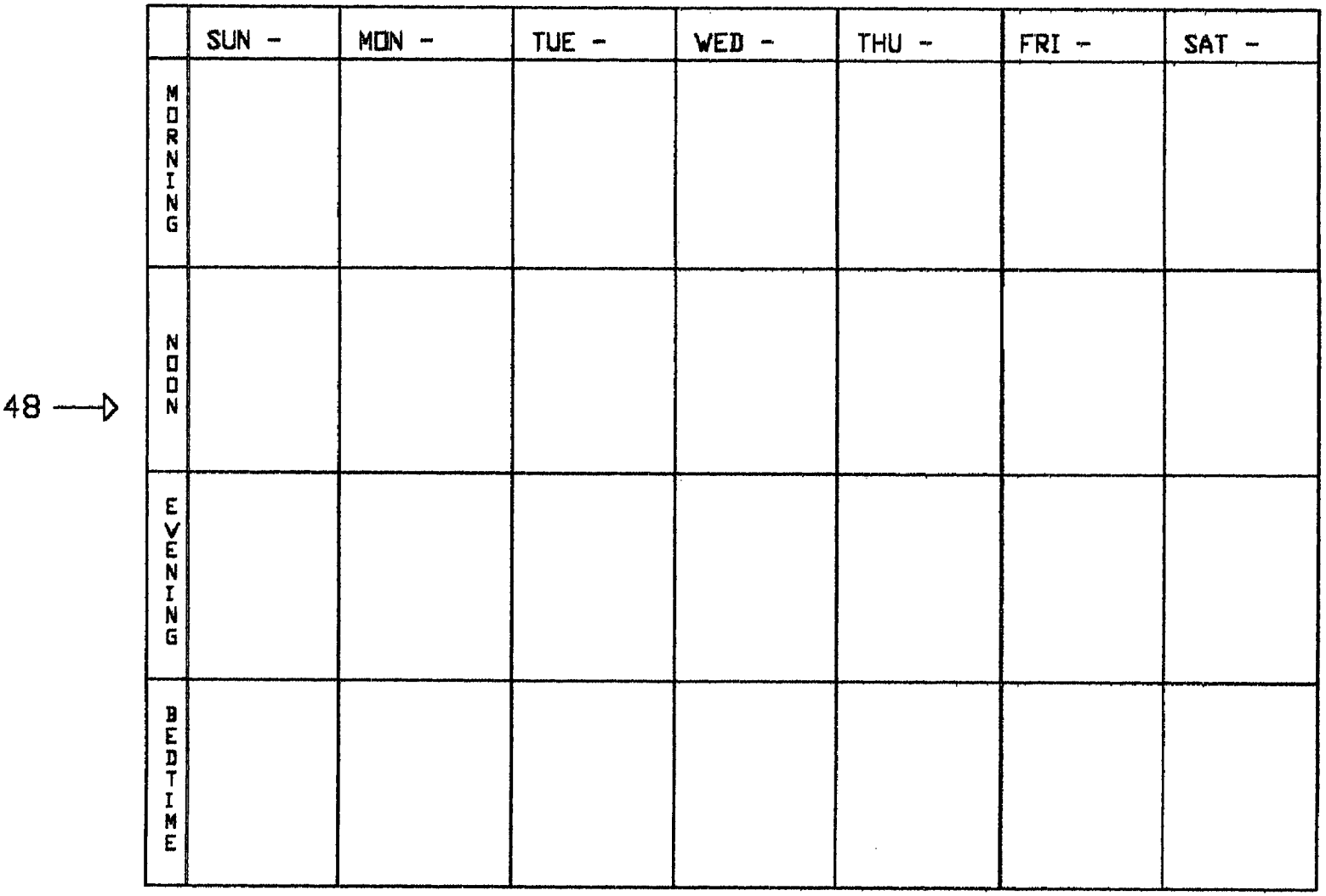
FIG. 12 is the plan view of the preferred weekly Communication sheet.

Referring to FIGS. 8,9,10,11, the embodiment 20 will include a communications/records drawer 34, with a drawer handle 80. The drawer 34 will contain weekly communications sheets 48. Referring to FIG. 12 the sheets 48 will allow for final medical checks, medical questions, additional instructions, and recording of any medical concerns by the patient. The weekly communication sheets 48 will follow the same format of the seven-day four segments of day, to help alleviate possible confusion by the patient.

When the communication/records drawer 34 is slid open, it will set flush on a surface due to the molded bottom surface supports 52,54,56. The surface 54 will lock the drawer in place upon closing. Surface 56 will lock the drawer in place when opened. The communication/records drawer 34 has two integrally molded stops 50, to prevent the said drawer from being pulled free of the housing 22.

The communication/records drawer will be supported internally by the use of two plastic runners 62. The runners will be molded within the housing 22. The said runners will hold the said drawer 34 approximately one-eighth of an inch off of any flat surface.

Figure 13:
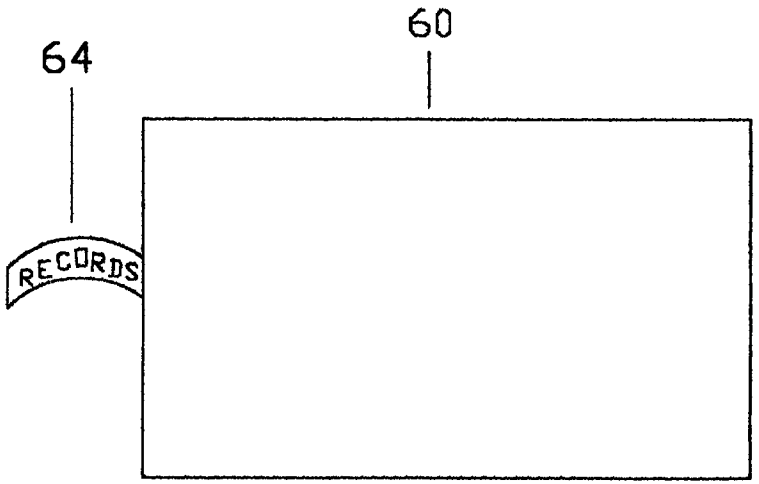
FIG. 13 is the plan view of the Divider used in the Communication/Records drawer.

The communication/records drawer will also serve in the capacity of storing the weekly communication sheets. Referring to FIG. 13, a translucent plastic divider 60 will be provided to separate the utilized sheets from the not yet utilized sheets. The divider 60 will incorporate a flexible nylon tab 64 to be used for identifying, grasping and lifting. The tab will be labeled with the indicia "Records".

What is claimed is:

1. A medicine dispensing and treatment monitoring apparatus consisting of:

a. a housing with a top surface engaging four sides, formed from medically accepted plastics;

b. a plurality of recessed areas formed in the top surface of the housing for supporting a seven day supply of medicine pill vials, wherein the top surface of the housing has medicine labels adjacent to each recessed area for supporting a seven day supply of pill vials;

c. seven one-day sets of removable segmented pill dispensers mounted with the housing, each one-day set of removable segmented pill dispensers has four compartments, wherein each of the four compartments represents a segment of the day;

d. an upward facing integrally recessed area with the housing for the storage of medicine containers larger than medicine vials;

e. an upward facing integrally recessed containment area with the housing for ease of sorting medicine with a graduated inclined surface;

f. a continuous display indicator providing day, segment of day, and time with preset segment functions comprising;

i. day display ii. segment of day display iii. time display g. a locking communications/records drawer for locking into the housing with a surface that locks the locking communications/records drawer upon closing or opening of the locking communications/records drawer, the locking communications/records drawer comprising:

i. an ergonomically designed handle for retrieving the drawer from the housing, ii. a stop to prevent the drawer from being pulled free of the housing, iii. and a plurality of molded bottom surface supports for locking the drawer in place in the open and closed positions, and holding the locking communications/records drawer off of the surface;

h. a plurality of weekly communication sheets contained within the locking communications/records drawer, for recording patient daily information for physician review; and i. a records divider with a tab for lifting for separating communications sheets.

2. The medicine dispensing and treatment monitoring apparatus of claim 1 wherein the plurality of recessed areas support medicine pill vials awaiting refill.

3. The medicine dispensing and treatment monitoring apparatus of claim 1, wherein the four compartments comprise: a morning compartment, a noon compartment, an evening compartment, and a bedtime compartment, and wherein each compartment has a hinge.

4. The medicine dispensing and treatment monitoring apparatus of claim 1, wherein the recessed containment area with the housing has a bottom, and the graduated inclined surface is disposed between the bottom of the recessed containment area with the housing and the top surface of the housing.

5. The medicine dispensing and treatment monitoring apparatus of claim 1, further comprising a lip disposed around the housing top surface for preventing medicines from rolling off the housing surface to a ground surface.

6. The medicine dispensing and treatment monitoring apparatus of claim 5, wherein the lip has a height of ⅛ inch.

7. The medicine dispensing and treatment monitoring apparatus of claim 1, wherein the records divider with a tab for lifting is a translucent plastic records divider for separating used weekly communication sheets from not yet used weekly communication sheets.

8. The medicine dispensing and treatment monitoring apparatus of claim 1 wherein the plurality of recessed areas formed in the housing have forty five degree flares to guide medicine pill vials into each of the plurality of recessed areas.

9. The medicine dispensing and treatment monitoring apparatus of claim 1, wherein the plurality of weekly communication sheets provide an area for noting questions, instructions, concerns, side effects and symptoms for later diagnosis.

10. The medicine dispensing and treatment monitoring apparatus of claim 1, further comprising labeling areas with labeling shoulders for receiving labels for each of the recessed areas in the plurality of recessed areas.

11. The medicine dispensing and treatment monitoring apparatus of claim 1 wherein the continuous display indicator providing day, segment of day, and time with preset segment functions is programmable to display the day, segment of day and time in most modern languages.

12. The medicine dispensing and treatment monitoring apparatus of claim 1, wherein the locking communications/records drawer is disposed in the left side of the housing forming a "left handed" model of the medicine dispensing and treatment monitoring apparatus.

* * * * *